US006224426B1

(12) United States Patent
Kaneko

(10) Patent No.: US 6,224,426 B1
(45) **Date of Patent: *May 1, 2001**

(54) ELECTRICAL JUNCTION BOX

(75) Inventor: Nobutaka Kaneko, Shizuoka (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/148,144

(22) Filed: Sep. 4, 1998

(30) Foreign Application Priority Data

Sep. 4, 1997 (JP) ..... 9-239908

(51) Int. Cl.[7] ..... H01R 13/68
(52) U.S. Cl. ..... 439/621; 439/949
(58) Field of Search ..... 439/76.2, 949, 439/621, 622, 135, 142, 143, 147; 361/833

(56) References Cited

U.S. PATENT DOCUMENTS 4,097,109 * 6/1978 Cross ..... 439/557
4,213,013 * 7/1980 Perna et al. ..... 179/98
4,221,455 * 9/1980 Cairns et al. ..... 439/949
4,923,411 * 5/1990 Hayashi et al. ..... 439/949
4,940,419 * 7/1990 Kurita et al. ..... 439/76.2
5,171,155 * 12/1992 Mendoza ..... 439/134
5,403,193 * 4/1995 Ito et al. ..... 439/76.2
5,877,944 * 3/1999 Onizuka ..... 439/76.2
5,995,380 * 11/1999 Maue et al. ..... 439/76.2

FOREIGN PATENT DOCUMENTS 3-57852 6/1991 (JP) ..... H01H/85/00
5-33444 4/1993 (JP) ..... H01H/85/56

* cited by examiner

*Primary Examiner*—Tulsidas Patel
(74) *Attorney, Agent, or Firm*—Sughrue, Mion, Zinn, Macpeak & Seas, PLLC

(57) ABSTRACT

An electrical junction box for electrically connecting a plurality of cables through a fusible link, comprises a body, an inserting section into which the fusible link is insertable, and fixing sections to which the cables can be fixed. In the electrical junction box, the inserting section and the fixing sections are so arranged on the body that the inserting section and the fixing sections face in the same direction.

14 Claims, 2 Drawing Sheets

ELECTRICAL JUNCTION BOX

BACKGROUND OF THE INVENTION

1. Field of the Invention

This invention relates to an electrical junction box which is arranged, for instance, in the engine room of an automobile.

The present application is based on Japanese Patent Application No. Hei. 9-239908, which is incorporated herein by reference.

2. Description of the Related Art

As shown in FIG. 2, an electrical junction box 20 arranged in an engine room of an automobile comprises a body 25 including an inserting section 23 in which the fusible link 21 is insertable and fixing sections 24 and 24 in which cables 22 and 22 can be fixed. In the electrical junction box 20, a plurality of cables 22 and 22 is electrically connected through a fusible link 21 to each other.

The fusible link 21 has a pair of terminals 21A and 21A that are inserted in the inserting section 23 from above in FIG. 2 so as to penetrate the body 25. On the other hand, the cables 22 and 22 have connecting terminals at their ends, and are inserted into the fixing sections 24 and 24 from below in FIG. 2.

The fusible link 21 is electrically connected to the cables 22 in the body 25 as follows: The terminals 21A and the connecting terminals 22A are initially laid one on another. Under this condition, fixing bolts 26 are respectively passed through those terminals 21A and 22A. Then, the fixing bolts 26 are respectively engaged with nuts 27.

Incidentally, a bus bar insert-molded in the body 25 may be provided between the terminals 21A of the fusible link 21 and the connecting terminals 22A of the cables 22.

In the above-described conventional electrical junction box 20, with respect to the body 25, the inserting section 23 and the fixing sections 24 and 24 are arranged in opposite direction, Therefore, if the body 25 is so arranged in the engine room that a worker operates downward the connection and disconnection of the fusible link 21 or the cables 22, then such operation is considerably troublesome.

SUMMARY OF THE INVENTION

In view of the foregoing, an object of the invention is to provide an electrical junction box with which the connection and disconnection of the fusible link and the cables can be easily achieved.

In order to achieve the foregoing object, according to the first aspect of the present invention, there is provided an electrical junction box for electrically connecting a plurality of cables through at lease one fusible link, which comprises: a body; an inserting section into which the fusible link is insertable; and fixing sections to which the cables can be fixed; wherein the inserting section and the fixing sections are so arranged on the body that the inserting section and the fixing sections face in the same direction.

In the body, the bus bars may be insert-molded to couple the inserting section and the fixing section to one another. The body is optional in configuration.

In the case where the body is substantially rectangular, the inserting section and the fixing sections may be arranged on one and the same surface of the body, or the inserting section and the fixing sections may be arranged on the side surfaces of the body which are adjacent to each other. All that is necessary is that the directions of insertion of the fusible link and the cables are the same.

In the electrical junction box, the inserting section and the fixing sections are arranged in the same direction; in other words, the fusible link and the cables are inserted in the same direction.

Accordingly, in the case where, for instance, in the engine room of an automobile, the body is so arranged that the inserting section and the fixing sections face upwardly, the engagement and disengagement of the fusible link and the cables can be easily achieved. That is, the electrical junction box is much higher in workability than the conventional one. Incidentally, the cables may be connected to terminals, and the terminals may be fixed to the fixing sections.

According to the second aspect of the present invention, the electrical junction box is formed to further comprise a cover section covering the inserting section and the fixing sections, the cover section having at lease two inserting holes through which the cables are passable, the inserting holes being communicated with a periphery portion of the cover section.

The cover section may be in the form of a bottomed cylinder, a roof, a pyramid, or a flat plate. That is, the configuration of the cover section is not particularly limited—all that is necessary for the cover is that the cover is able to cover the inserting section and the fixing sections as one unit. In addition, the inserting holes may be substantially U-shaped so that they correspond to the sectional configuration of the cables and that the configuration of the opening thereof is continuous to the periphery of the cover section. That is, the inserting holes may be defined by U-shaped edges formed along the periphery portion of the cover section, respectively.

In the electrical junction box thus constructed, the inserting holes formed in the cover section are continuous to the periphery of the cover section. Therefore, when the cover is engaged with or disengaged from the body, the cables may be moved from the inserting holes to the periphery of the cover section. That is, with the cables secured to the fixing sections, the cover may be disengaged from or engaged with the body.

In other words, with the electrical junction box, even if the connectors are connected to the ends of the cables, the cover section may be smoothly engaged with or disengaged from the body. This means that the work with respect to the electrical junction box can be achieved with high efficiency.

That is, the cover section is detachably attached to the body. Also, the cover section may have a engaging portion, and the body may have a retaining portion so that the engaging portion and the retaining portion are detachably engaged with each other.

DETAILED DESCRIPTION OF THE PREFERRED EMBODIMENT

An electrical junction box of an embodiment of the present invention will be described with reference to FIG. 1.

Figure 1:
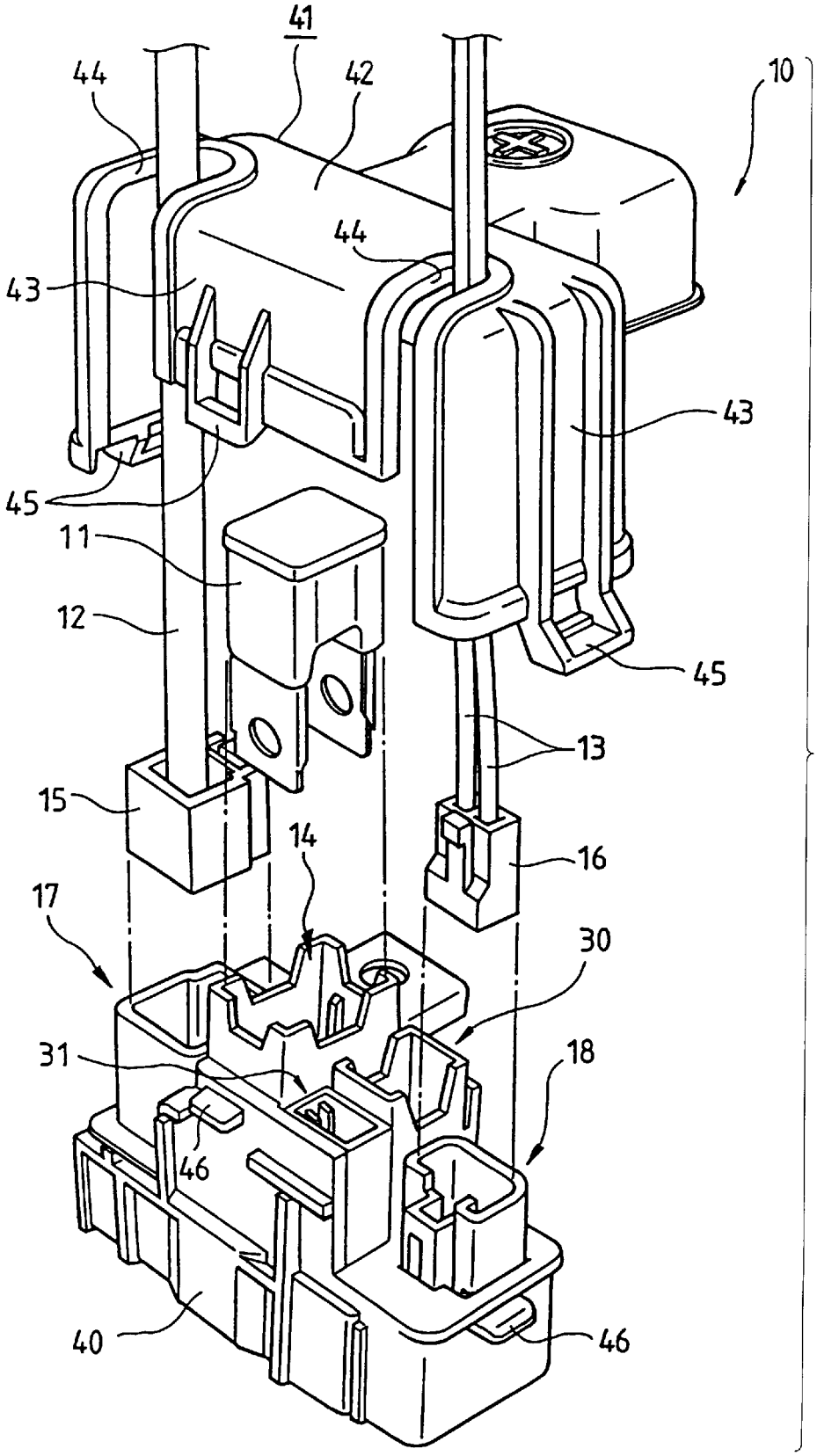
FIG. 1 is an exploded perspective view of an electrical junction box of an embodiment of the present invention.
Figure 2:
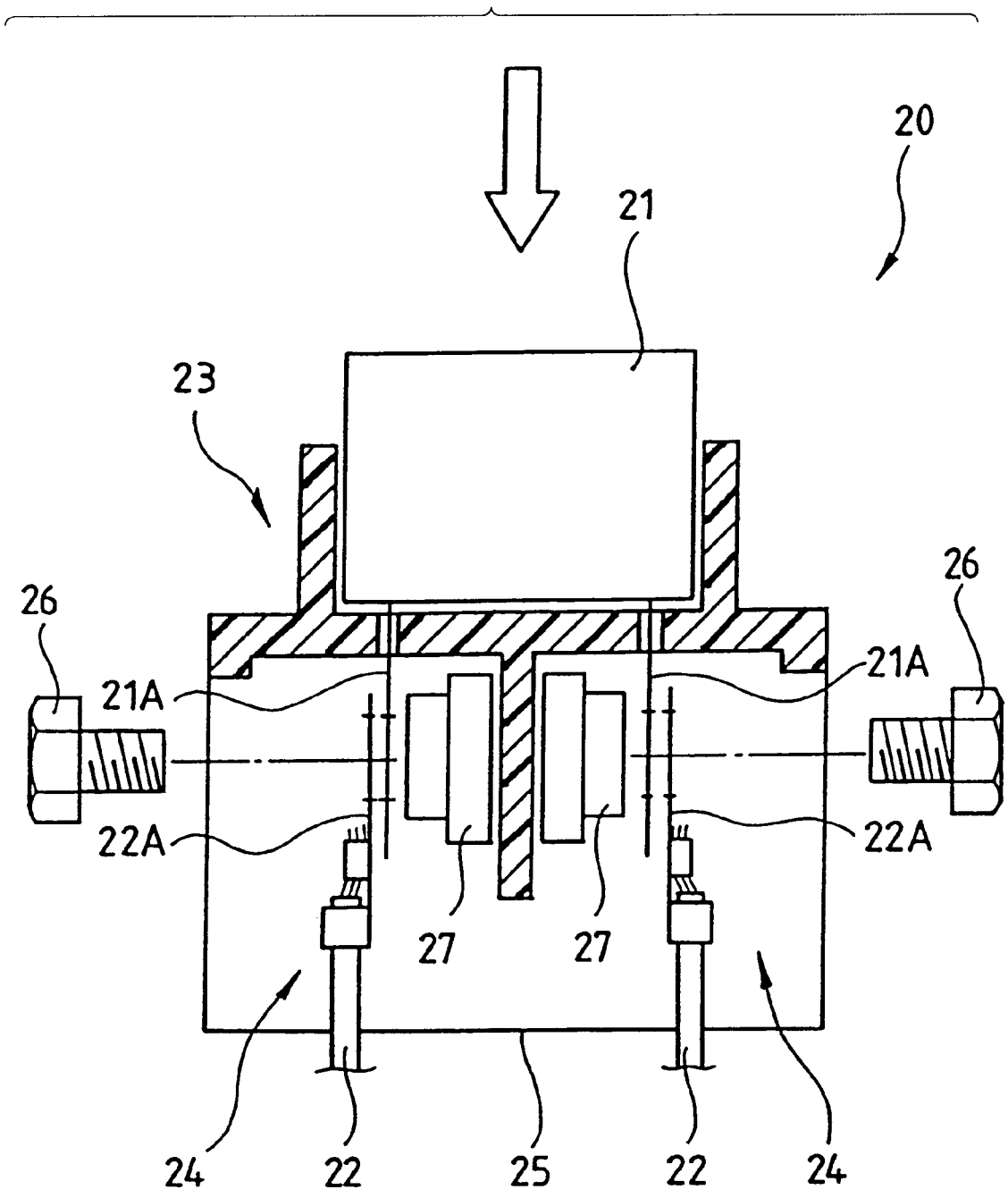
FIG. 2 PRIOR ART
FIG. 2 is a sectional view, partly as an explanatory diagram, outlining a conventional electrical junction box.

In FIG. 1, reference numeral 10 designates the electrical junction box of the present invention. The electrical junction box 10 is arranged on the inner surface of the engine of an automobile. The electrical junction box 10 is to electrically connect a pair of cables 12 and 13 through a fusible link 11.

A body 40 of the electrical junction box 10 includes an inserting section 14 in which the fusible link 11 is insertable, and fixing sections 17 and 18 in which the connectors 15 and 16 connected to the cables 12 and 13 are fixedly inserted. Inserting sections 30 and 31 in which the other fusible links (not shown) are insertable, are formed between the inserting section 14 and the fixing section 18.

The above-described body 40, the inserting sections 14, 30 and 31 and the fixing sections 17 and 18 are made of a suitable material for insulation. Further, the body 40 is integrally formed with the inserting sections 14, 30 and 31 and the fixing sections 17 and 18 so that the inserting sections 14, 30 and 31 and the fixing sections 17 and 18 are faced in the same direction. Furthermore, the inserting sections 14, 30 and 31 and the fixing sections 17 and 18 are electrically connected to one another selectively through bus bars (not shown) built in the body 40 by insert molding.

In the electrical junction box 10, the fusible link 11 and the cables 12 and 13 are so designed that they can be inserted in the inserting section 14 and the fixing sections 15 and 16 from the above in FIG. 1.

The electrical junction box 10 further comprises a cover section 41 adapted to cover the inserting sections 14, 30 and 31 and the fixing sections 17 and 18.

The cover section 41 is substantially formed in a bottomed-rectangular cylindrical shape comprising a bottom section 42 and a side section 43 coupled to the bottom section 42. The bottom section has inserting holes 44 and 44 through which the cables 12 and 13 are passable. The inserting holes 44 and 44 communicate with the edges of the side section 43, and are substantially U-shaped so as to guide the cables 12 and 13.

The side section 43 has engaging portions 45. On the other hand, the body 40 has pawls 46. The engaging portions 45 are detachably engaged with the pawls 46 of the body 40. That is, the cover section 41 is detachably engaged with the body 40.

According to the above-described electrical junction box 10, the inserting sections 14, 30 and 31 and the fixing sections 17 and 18 are arranged to extend in the same direction while leaving away from the body 40. Therefore, if the body 40 is so set in the engine room of the automobile that the inserting sections 14, 30 and 31 and the fixing sections 17, 18 extend upwardly, then the detachable engagement of the fusible link 11 and the cables 12 and 13 by downward operation of a worker can be easily and positively achieved. In other words, the electrical junction box of the present invention is much higher in workability than the conventional one.

Further, since the inserting holes 44 and 44 formed in the cover section 41 communicate with the edges of the side section 43, when the cables 12 and 13 are moved from the inserting holes 44 to the edges of the side section 43, the cover 41 can be easily engaged with or disengaged from the body 40 without being obstructed by the connecters 15 and 16 secured to the fixing sections 17 and 18.

Incidentally, the body 40 and the cover section 41 may be so set that the front side of the side section 43 with which the inserting holes 44 and 44 communicate are opposed to the inner surface of the engine room. Accordingly, moisture or dust may not enter the inside of the cover 41, and further, such arrangement minimizes the frequency of unsatisfactory connection or short-circuiting of the cables.

Furthermore, the substantially U-shaped inserting holes 44 and 44 of the cover section 41 can serve as heat radiating holes. Therefore, the heat generated by the inserting sections 14, 30 and 31 and the fixing sections 17 and 18 is effectively radiated. This feature maintains the initial functions of the electrical junction box unchanged for a long time.

What is claimed is:

1. An electrical junction box for electrically connecting a plurality of cables through at least one fusible link, comprising:

a body;

an inserting section provided in the body, and into which the fusible link is insertable; and a plurality of fixing sections provided in the body, and to which the cables can be fixed;

wherein all of the inserting section and the fixing sections face in one direction, and said electrical junction box does not have a fixing section that faces in a direction other than said one direction; and wherein the inserting section is positioned between two of the fixing sections.

2. The electrical junction box of claim 1, further comprising a cover section covering the inserting section and the fixing sections, the cover section having at lease two inserting holes through which the cables are passable, the inserting holes being communicated with a periphery portion of the cover section.

3. The electrical junction box of claim 2, wherein the cover section is detachably attached to the body.

4. The electrical junction box of claim 3, wherein the cover section has an engaging portion, the body has a retaining portion, and wherein the engaging portion and the retaining portion are detachably engaged with each other.

5. The electrical junction box of claim 2, wherein the inserting holes are defined by U-shaped edges formed along the periphery portion of the cover section, respectively.

6. The electrical junction box of claim 1, wherein the cables are connected to terminals, and the terminals are fixed to the fixing sections.

7. The electrical junction box of claim 4, wherein the engaging portion is formed between two inserting holes.

8. The electrical junction box of claim 5, wherein the U-shaped edges extend into a top of the cover section.

9. An electrical junction box for electrically connecting a plurality of cables through at least one fusible link, comprising:

a body;

an inserting section provided in the body, and into which the fusible link is insertable;

a plurality of fixing sections provided in the body, and to which the cables can be fixed; and a cover section covering all of the inserting section and the fixing sections, the cover section having at lease two inserting holes through which the cables are passable, the inserting holes being communicated with a periphery portion of the cover section;

wherein the cover section is detachably attached to the body;

wherein the inserting section and the fixing sections face in the same direction;

wherein the cables are connected to terminals, and the terminals are fixed to the fixing sections; and wherein the inserting section is positioned between two of the fixing sections.

10. The electrical junction box of claim 9, wherein the cover section has an engaging portion, the body has a retaining portion, and wherein the engaging portion and the retaining portion are detachably engaged with each other.

11. The electrical junction box of claim 9, wherein the inserting holes are defined by U-shaped edges formed along the periphery portion of the cover section, respectively.

12. The electrical junction box of claim 10, wherein the engaging portion is formed between two inserting holes.

13. The electrical junction box of claim 11, wherein the U-shaped edges extend into a top of the cover section.

14. An electrical junction box for electrically connecting a plurality of cables through at least one fusible link, comprising:

a body;

an inserting section provided in the body, and into which the fusible link is insertable;

a plurality of fixing sections provided in the body, and to which the cables can be fixed; and a cover section covering all of the inserting section and the fixing sections, the cover section being detachably attached to the body;

wherein the inserting section is positioned between two of the fixing sections.

* * * * *